United States Patent [19]

Grundy

[11] Patent Number: 4,708,291

[45] Date of Patent: Nov. 24, 1987

[54] OSCILLATING SPRINKLER

[75] Inventor: Michael J. Grundy, Phelan, Calif.

[73] Assignee: The Toro Company, Minneapolis, Minn.

[21] Appl. No.: 942,466

[22] Filed: Dec. 16, 1986

[51] Int. Cl.[4] ..... B05B 3/16

[52] U.S. Cl. ..... 239/242; 74/79

[58] Field of Search ..... 239/240, 242; 74/79, 74/810, 812, 462, 460

[56] References Cited

U.S. PATENT DOCUMENTS

| | | | |
|---|---|---|---|
| 2,187,549 | 9/1936 | Thompson | 239/242 |
| 3,107,056 | 10/1963 | Hunter . | |
| 3,724,757 | 4/1973 | Hunter . | |
| 4,568,024 | 2/1986 | Hunter | 239/242 |

*Primary Examiner*—Andres Kashnikow
*Assistant Examiner*—C. Trainor
*Attorney, Agent, or Firm*—James W. Miller

[57] ABSTRACT

A sprinkler (2) includes a rotary nozzle (6) mounted on a body (4). A reversible drive (12) includes an internal gear (14) connected to the nozzle (6), a motor (16) having a unidirectional output shaft (18), and an oscillating gear train (20) having two final drive gears (27) or (29) which rotate reversely relative to one another and are engageable with driven gear (14) for reversing the direction of nozzle rotation. The first and second final drive gears (27) and (29) are mounted on first and second pivot arms (22*a*) and (22*b*) and are part of two gear sets (26) or (28). The numbers of gears in each gear set (26) or (28) is selected in conjunction with the direction of the pivoting motion of the pivoting arms (22*a*) or (22*b*) so that the additional rotation induced on the final drive gears as they rotate above the stationary part of the gear train (20) will always be counter to the normal direction of rotation thereof.

7 Claims, 6 Drawing Figures

OSCILLATING SPRINKLER

TECHNICAL FIELD

This invention relates generally to a rotary sprinkler powered by a reversible drive that rotates the sprinkler back and forth in opposed directions, e.g. clockwise and counterclockwise. More particularly, this invention relates to an improved drive which is easily disengageable at the moment of drive reversal.

BACKGROUND OF THE INVENTION

Rotary sprinklers are well known in the irrigation field and usually comprise a nozzle that ejects a stream of water as it is rotated about its longitudinal axis. Some such sprinklers are known as part-circle sprinklers and include nozzles which oscillate back and forth between two arc limits to water only a portion of a circle. Accordingly, part-circle sprinklers include some type of reversible drive which reverses the direction of nozzle rotation at each of the arc limits. the assignee of the present invention, The Toro Company, has made and sold sprinklers of this type known as the SUPER 600 ® and SUPER 606 TM .

U.S. Pat. No. 3,107,056 discloses one type of reversible drive used in prior art part-circle sprinklers. In this drive, a unidirectional input gear is part of a gear train that includes two different gear sets, having unequal numbers of gears, which end in two drive gears that rotate in opposite directions. The gear sets and input gear are mounted on a support yoke which is pivotable about the axis of the input gear. A shiftable trip arm oscillates the yoke between one of two positions in which one or the other of the drive gears has been swung into engagement with an internal driven gear carried on the nozzle. Thus, the nozzle rotates in different directions depending upon which drive gear is in engagement with the internal gear.

While the above-noted drive has been widely used in part-circle sprinklers, it has one major disadvantage, namely, the gear set having the larger number of gears engages the driven gear with considerably more force than the other gear set. In some cases, this additional force is so great as to make drive reversal difficult or impossible, since it is merely the trip arm carried by the nozzle which acts on the support yoke to shift the yoke from one orientation to the other. Therefore, some sprinklers of this type will not always reliably shift directions.

U.S. Pat. No. 4,568,024 to Hunter recognizes the problem described above and attempts to solve it in the prior art structure by using gears in the gear sets having different pressure angles on the different faces thereof. The apparent theory there is that by suitably controlling the pressure angle on the gear teeth, the drive gear can be made to slip out of the internal gear more easily, thereby allegedly solving the disengagement problem. However, as will be explained more fully in the Detailed Description, Applicant does not believe this approach truly solves the disengagement problem because it treats the symptoms of the problem without understanding or discovering the basic cause of the problem. Moreover, even if there were some validity to the pressure angle approach, it is a relatively difficult one to execute properly on a mass-produced basis because of the relatively close tolerances required in the manufacture of the pressure angles on the teeth of the various gears, which are after all quite small.

SUMMARY OF THE INVENTION

One aspect of this invention is an improved sprinkler of the type having a nozzle which is rotatable about an axis of rotation. A reversible drive means rotates the nozzle in opposed first and second directions. The drive means includes a driven gear nonrotatably fixed to the nozzle, and first and second final drive gears which normally rotate reversely relative to one another and which are alternately engageable with the driven gear for achieving the opposed directions of nozzle movement. The improvement of the present invention comprises means for pivotally supporting each of the final drive gears for a swinging motion towards and away from the driven gear. In addition, some means is provided for rotating each of the drive gears reversely relative to the normal rotation thereof when each final drive gear is pivoted away from the driven gear, thereby allowing the final drive gears to more easily disengage the driven gear.

BRIEF DESCRIPTIONS OF THE DRAWINGS

This invention will be described in more detail hereafter, when taken in conjunction with the following drawings, in which like reference numerals refer to like elements throughout.

Figure 1:
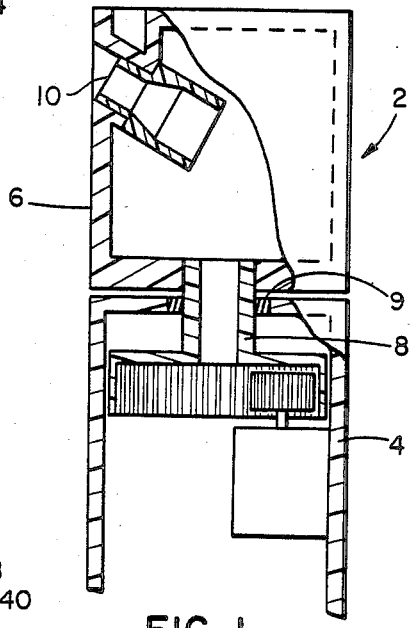
FIG. 1 is a side elevational view, partially broken away and shown in cross-section, of a rotary sprinkler in which the improved reversible drive of the present invention is embodied, the drive being shown only diagrammatically in FIG. 1.
Figure 4:
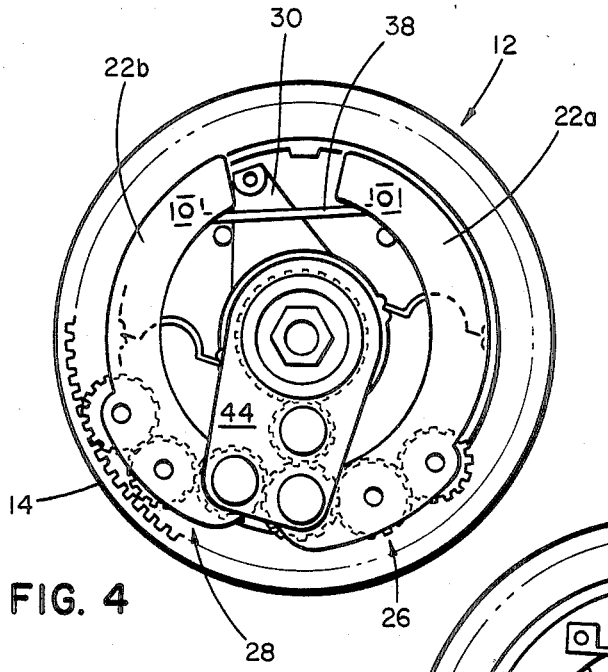
FIG. 4 is a top plan view of the reversible drive shown in FIG. 3, particularly illustrating the drive shifted into a first driving orientation with one of the final drive gears in engagement with the driven gear.
Figure 5:
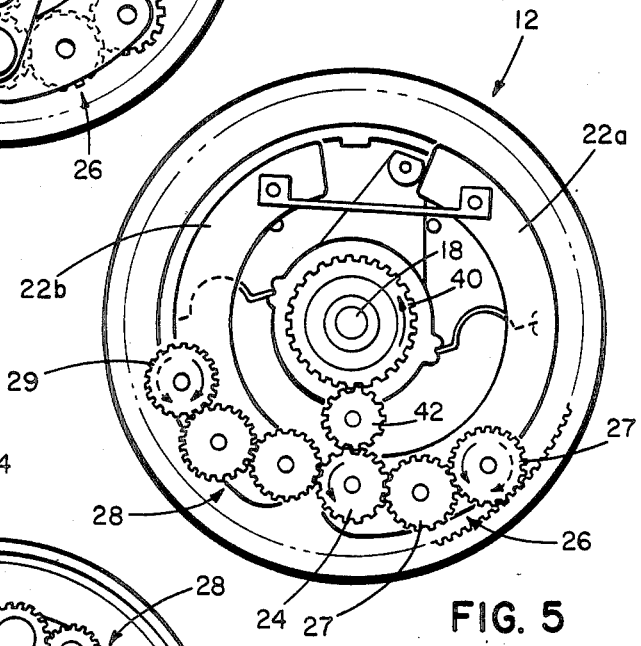
Figure 6:
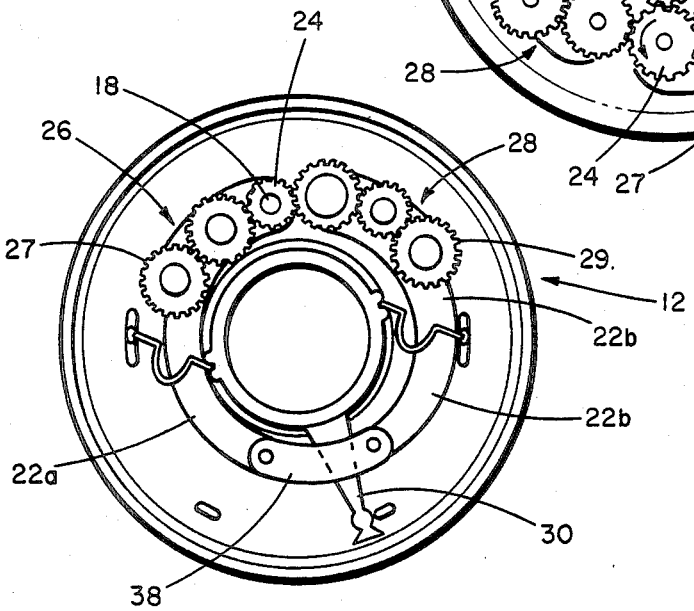

FIG. 5 is a partial top plan view similar to FIG. 4, but having the top pivot arms deleted for the sake of clarity and showing the drive shifted into its other driving orientation with the other final drive gear in engagement with the driven gear; and FIG. 6 is a top plan view of a second embodiment of an improved reversible drive according to the present invention which is usable in sprinklers of the type shown in FIG. 1, where the driven gear has been omitted for clarity.

DETAILED DESCRIPTION

The present invention relates to an improved reversible drive which is usable in a part-circle sprinkler diagrammatically shown as 2 in FIG. 1. Such sprinklers 2 typically include a cylindrical body 4 which receives water under pressure. A nozzle 6 is rotatably supported on top of body 4 for rotation about a substantially vertical axis defined by a hollow tube or shaft 8 which extends into body 4 through a seal 9. Nozzle 6 includes an orifice 10 through which the water admitted into nozzle 6 through shaft 8 is ejected to water a circular pattern as nozzle 6 rotates. A reversible drive 12 in body 4 includes an internal driven gear 14 nonrotatably connected to nozzle 6, e.g. by keying to shaft 8, a drive motor 16 actuated by the water flow which has a unidirectional output shaft 18, and an oscillating gear train 20 coupled to output shaft 18 having at least two reversely rotating drive gears thereon which are alternately engaged with driven gear 14 for driving nozzle 6 in opposed first and second directions. When such a reversible drive 12 is used, nozzle 6 rotates back and forth between two arc limits, which may be preset or adjustable, to water only a portion of a circle, thus the name part-circle sprinkler 2.

Sprinkler 2 as disclosed herein could be directly connected to a source of water by coupling body 4 to a water pipe, or the components of sprinkler 2 could form a pop-up riser which is held by a spring in a retracted position within an outer housing that is itself coupled to the water source. U.S. Pat. No. 3,724,757 discloses a sprinkler of the latter type having a pop-up riser which includes a rotary nozzle and reversible drive of the kind pertinent to the present invention. In addition, U.S. Pat. No. 3,107,056 discloses the same type of reversible drive used in a sprinkler. Both of these patents are incorporated by reference herein for teaching constructional details relative to rotary nozzle 4 and reversible drive 12.

Figure 2:
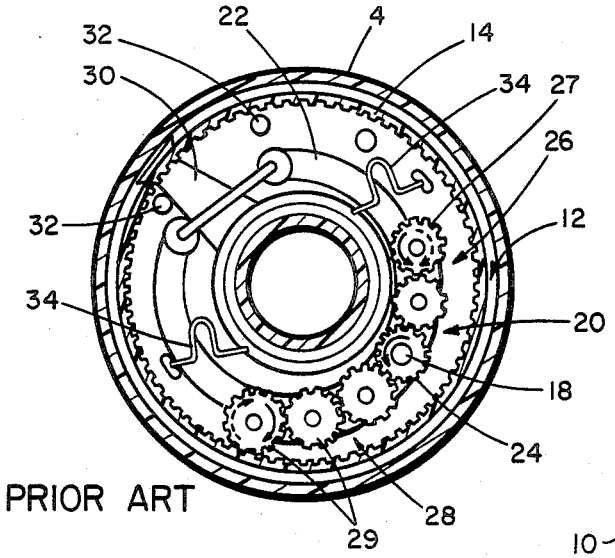
PRIOR ART FIG. 2
FIG. 2 is a top plan view of a prior art reversible drive used in sprinklers of the type shown in FIG. 1.

Referring now to FIG. 2, a prior art reversible drive 12 (as shown in the above-referenced patents) will be briefly described so the present invention, which relates to an improved drive 12, can be better appreciated. Drive 12 includes a horseshoe-shaped yoke 22 pivotably journalled on the top surface of motor 16 for an oscillating movement about the pivot axis formed by output shaft 18 which extends upwardly out of motor 16. A gear train 20 is carried on yoke 22 and is defined by an input gear 24 received on output shaft 18 and two different gear sets 26 and 28 connected to either side of the input gear, having unequal numbers of gears 27 and 29, respectively, so that the final gears 27 or 29 in each of the gear sets 26 and 28 rotate in reverse directions. As shown, the first gear set 26 includes two gears 27 to one side of input gear 24, with the final drive gear 27 rotating in the same direction as the input gear 24, and the second gear set 28 includes three gears, to the other side of input gear 24, with the final drive gear 29 rotating reversely compared to input gear 24.

As described clearly in the above-incorporated patents, a pivotal trip arm 30 pivots between two stops 32 by virtue of various tabs (not shown) contained on the moving nozzle 6 which come into engagement with trip arm 30. Overcenter springs 34 assist in the pivoting of trip arm 30 once it begins and help bias trip arm 30 against stops 32. As trip arm 30 pivots, it engages one of the outwardly extending legs of yoke 22 to shift or oscillate yoke 22 from a first position in which final drive gear 27 is in engagement with internal gear 14 to a second position in which the other final drive gear 29 has come into engagement with gear 14 and the first drive gear 27 has disengaged it. This is what reverses the direction of rotation of nozzle 6.

Turning now to the operation of the prior art drive 12 just discussed, Applicant and others have observed that it is more difficult to reverse the drive (i.e. it takes more force) when the three gear set 28 is in engagement with the driven gear 14 than when the two gear set 26 is in engagement with gear 14. In some cases, the action of trip arm 30 on yoke 22 is not sufficient to disengage gear set 28 from gear 14, thereby preventing drive reversal of nozzle 6. One prior art suggestion for solving this acknowledged problem has been to change the pressure angles on the teeth of internal gear 14 and gears 27 and 29, as previously noted in the Background of the Invention section. However, Applicant has discovered the underlying cause of this disengagement problem and has invented a solution to the problem which more directly addresses the cause than does adjusting the pressure angles of the gear teeth.

Before discussing Applicant's improved drive 12, it would be helpful to set forth the observations made by Applicant which led to the present invention. Normally, when drive motor 16 is actuated by the water flow and shaft 18 is rotating, all of the gears 24, 27 and 29 in gear train 20 have a customary direction of rotation which is illustrated in FIG. 2 by the solid line arrows. As Applicant studied the operation of gear train 20, he considered what happens when the normal rotation of the gears is absent, e.g. shaft 18 is stationary. In this particular case, Applicant noticed that as yoke 22 oscillates from one driving position to the other, a small amount of additional rotation is induced on the gears 27 and 29 in each of the gear sets 26 and 28 by virtue of the pivoting motion of the yoke itself. Referring to FIG. 2, where the three gear set 28 is shown in engagement with internal gear 14, as yoke 22 pivots to disengage gear set 28 from the internal gear, the gears 29 in gear set 26 follow an arc about the periphery of input gear 24. In effect, the gears 29 have to walk around the periphery of input gear 24 as yoke 22 pivots and this "walking around" action actually induces some further rotation in these gears.

After discovering that a small amount of additional rotation is induced in gear sets 26 and 28 simply by virtue of the pivoting motion of yoke 22, Applicant then made the further discovery that the final drive gears 27 and 29 in each of the gear sets 26 and 28 do not have the same kind of additional rotation as they disengage the internal gear 14. In the case of the two gear set 26, the additional rotation of the prior art structure, shown by the dotted arrows in FIG. 2, runs counter to the normal rotation imposed on the final drive gear 27 by motor 16. However, this is not true of the final drive gear 29 in the three gear set 28 of the prior art structure. For that drive gear, the additional rotation induced thereon simply by virtue of the pivoting of yoke 2 was in the same direction as the normal direction of rotation imposed on that drive gear by motor 16. Applicant believes that this difference in the additional rotation induced on the final drive gears simply by virtue of the pivoting motion of yoke 22 is the reason why the two gear set disengaged more easily than the three gear set in the prior art device. In effect, Applicant believes that the additional rotation of the final drive gear 29 in the three gear set 28 was tending to accelerate that gear more firmly into engagement with internal gear 14, while the contrary rotation for the final drive gear 27 in the two gear set 26 was tending to decelerate gear 27 away from the internal gear 14, thereby making disengagement easier.

Figure 3:
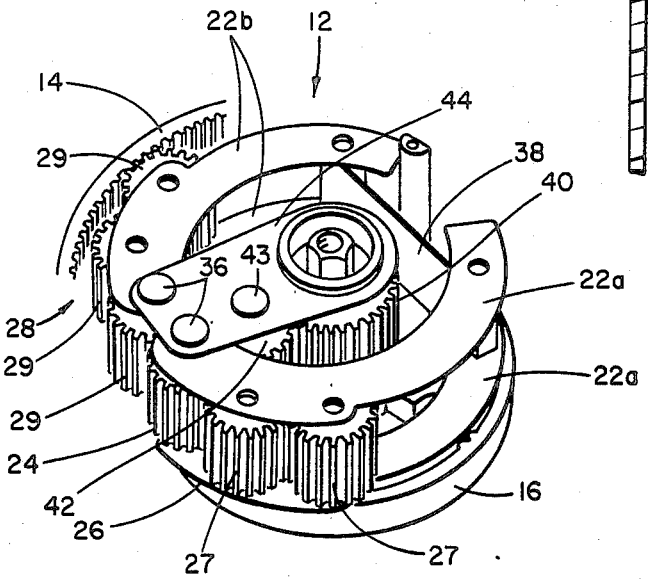
FIG. 3 is a perspective view of a first embodiment of an improved reversible drive according to the present invention which is usable in sprinklers of the type shown in FIG. 1.

After Applicant made the above discovery, he then resolved to solve the problem of the disengagement of the prior art drive 12 by making the final drive gears 27 and 29 in each of the gear sets 26 and 28 behave the same way with respect to the question of the additional rotation induced by the pivoting of the yoke, i.e. by making this additional rotation be contrary to the normal direction of rotation of the drive gear regardless of which gear set is being disengaged from the interal gear. FIGS. 3–5 illustrate a first embodiment of a reversible drive 12 according to the present invention, in which the above objective has been accomplished, with the same reference numerals being used to refer to the same elements of the improved drive 12 as in the prior art drive 12 just discussed. Basically, the solution which achieves Applicant's objective in this embodiment is to support the first and second gear sets 26 and 28 on two separate first and second pivot arms 22*a* and 22*b* which pivot respectively about different pivot axes. With respect to the first pivot arm 22*a* on which gear set 26 is pivotally carried, the pivot axis is still the axis of input gear 24, i.e. the gear which receives the driving force from motor 16. However, the pivot axis for the second pivot arm 22*b* is now the axis of the next adjacent gear or the first gear 29 in the three gear set 28. In effect, the three gear set 28 could now be referred to as a two gear set because the first gear 29 in that set does not now pivot with the rest of the set as before, but serves as the second pivot point. Both of the described pivot axes are simply pins 36 which extend through the gears and down into the top of a suitable support structure contained in sprinkler body 4, such as the top of drive motor 16. Since now there is some relative motion between the pivot arms 22*a* and 22*b*, a link arm 38 has its ends pivotally journalled in each pivot arm 22*a* and 22*b* so that the pivoting motion of one pivot arm will cause the pivoting of the other pivot arm as well, i.e. engagement of one arm disengages the other.

The embodiment shown in FIGS. 3–5 discloses the use of first and second pivot arms 22*a* and 22*b*, which are arranged in sets of two and are spaced apart to receive the gears in the gear sets 26 and 28 therebetween in a sandwich fashion. However, the use of two spaced apart first and second pivot arms is not necessary to the present invention, the gears could be carried on only a single first and second pivot arm, as illustrated in the embodiment shown in FIG. 6. In addition, the embodiment of FIGS. 3–5 illustrates that the drive to gear train 20 can come from the center of drive motor 16 with shaft 18 being received in a center gear 40. An additional intermediate gear 42, which is pivotally supported by a pivot pin 43 in a support plate 44 extending between center gear 40 and gear train 20, is used to transfer the drive out to gear train 20 from center gear 34. However, this is also not necessary and it would be possible to use Applicant's invention in a reversible drive similar to that of the prior art in which the output shaft 18 of drive motor is directly connected to input gear 24 in gear train 20. Again, this variation is illustrated in FIG. 6.

Considering now the operation of Applicant's improved drive 12, reference should be had to FIGS. 4 and 5 which illustrates the normal and additional rotations imposed on each of the gears in the gear sets 26 and 28 as the drive is being disengaged. It is now seen that regardless of which gear set 26 or 28 is in engagement with internal gear 14, the additional rotation induced on the final drive gear by virtue of the pivoting motion of pivot arms 22*a* and 22*b* as they pivot away from gear 14 is now counter to the normal gear rotation in each case. Applicant has determined through testing that this structure does in fact solve the disengagement problem with each gear set 26 and 28 now disengaging with the same amount of force. Accordingly, by simply splitting the support structure for the gear train 20 into two separate first and second pivot arms, and by selecting appropriately the number of gears in each of the gear sets in relation to the pivoting motion of the pivot arms as they disengage, Applicant has now invented a structure which directly addresses what Applicant believes to be the underlying cause of the disengagement problem. Accordingly, Applicant's structure more easily solves the problem without having to have specially shaped pressure angles on the gear teeth in both the gear sets and the internal gear, which can be difficult to accomplish consistently on a mass production basis and which may not be a reliable method for solving the problem.

Various modifications of this invention will be apparent to those skilled in the art. For example, the numbers of gears in each of the gear sets has to be selected by looking at how the pivot arms pivot when they disengage from driven gear 14 to insure that the additional rotation is always counter to the normal rotation of the gear. Obviously, gear sets 26 or 28 could have greater or lesser numbers of gears than that illustrated herein as long as the above relationship is kept in mind. Moreover, while the present invention shows a gear train 20 located inside an internal shell-type driven gear 14, the principles of the invention could be used in other arrangements of gear trains and driven gears, e.g. gear trains located outside of and engageable with an external driven gear. Thus, the scope of this invention is to be limited only by the appended claims.

I claim:

1. An improved sprinkler of the type having a nozzle which is rotatable about an axis of rotation, a reversible drive means for rotating the nozzle about its rotational axis in opposed first and second directions, wherein the drive means includes a driven gear nonrotatably fixed to the nozzle and first and second final drive gears which normally rotate reversely relative to one another and which are alternately engageable with the driven gear for achieving the opposed directions of nozzle movement, wherein the improvement relates to the first and second final drive gears and comprises:

(a) means for pivotally supporting each of the final drive gears for a swinging motion towards and away from the driven gear to engage or disengage the driven gear, respectively; and (b) means for rotating each of the final drive gears reversely relative to the normal rotation thereof when each final drive gear is pivoted away from the driven gear, thereby allowing the final drive gears to more easily disengage the driven gear.

2. An improved sprinkler of the type having a nozzle which is rotatable about an axis of rotation, a reversible drive means for rotating the nozzle about its rotational axis in opposed first and second directions, wherein the drive means includes a driven gear nonrotatably fixed to the nozzle, a undirectional output shaft, and a gear train coupled to the output shaft having first and second final drive gears at each end thereof which normally rotate reversely relative to one another and which are alternately engageable with the driven gear for achieving the opposed directions of nozzle movement, wherein the improvement relates to the gear train and comprises:

(a) a first gear set defined by a portion of the gear train at one end thereof and including at least one of the final drive gears;

(b) a first pivot arm for carrying the first gear set for a swinging motion about a pivot axis to selectively engage the final drive gear therein with the driven gear;

(c) a second gear set defined by a portion of the gear train at the other end thereof including at least the other final drive gear;

(d) a second pivot arm for carrying the second gear set for a swinging motion about a pivot axis to selectively engage the final drive gear therein with the driven gear; and (e) wherein the number of gears in each gear set is selected in conjunction with the direction of pivoting of the corresponding pivot arm such that the rotation induced on each final drive gear by the swinging of the corresponding pivot arm as each final drive gear disengages the driven gear is counter to the normal rotation of each final drive gear caused by rotation of the gear train, thereby allowing approximately the same force to disengage each final drive gear from the driven gear.

3. An improved sprinkler as recited in claim 2, wherein the first pivot arm is journalled about a first pivot axis, and wherein the second pivot arm is journalled about a second pivot axis different from the first pivot axis.

4. An improved sprinkler as recited in claim 3, wherein the first and second pivot axes are defined by the axes of those gears in the gear train which are immediately adjacent to the first and second gear sets respectively.

5. An improved sprinkler as recited in claim 4, wherein one of the first and second pivot axes is further defined by the output shaft of the drive means.

6. An improved sprinkler as recited in claim 2, further including linkage means pivotally secured to each of the first and second pivot arms for linking the arms together for movement as a unit, whereby pivoting of one pivot arm also pivots the other pivot arm.

7. An improved sprinkler as recited in claim 2, wherein the driven gear comprises an internal shell gear, and wherein the gear train and first and second pivot arms are located within the internal gear.

* * * * *